US010833388B2

(12) United States Patent
Chen et al.

(10) Patent No.: US 10,833,388 B2
(45) Date of Patent: Nov. 10, 2020

(54) COUPLERS FOR COMMUNICATIONS SYSTEMS

(71) Applicant: CommScope Technologies LLC, Hickory, NC (US)

(72) Inventors: Honghui Chen, Suzhou (CN); Yuemin Li, Suzhou (CN); Haifeng Li, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 7 days.

(21) Appl. No.: 16/454,377

(22) Filed: Jun. 27, 2019

(65) Prior Publication Data

US 2020/0028233 A1 Jan. 23, 2020

(30) Foreign Application Priority Data

Jul. 17, 2018 (CN) ..... 2018 1 0780299

(51) Int. Cl.
*H01P 5/16* (2006.01)
*H01P 5/18* (2006.01)
*H01P 3/08* (2006.01)

(52) U.S. Cl.
CPC ..... *H01P 5/16* (2013.01); *H01P 3/081* (2013.01)

(58) Field of Classification Search
CPC .... H01P 5/16; H01P 5/18; H01P 5/184; H01P 3/08; H01P 3/081
USPC ..... 333/109–112, 116
See application file for complete search history.

(56) References Cited

U.S. PATENT DOCUMENTS

| | | | | |
|---|---|---|---|---|
| 8,798,561 | B2 * | 8/2014 | Acimovic | H01P 5/184 455/126 |
| 8,942,658 | B2 * | 1/2015 | Banwell | H04B 1/58 455/269 |
| 9,716,306 | B2 * | 7/2017 | Kuroda | H03H 7/38 |
| 10,651,805 | B2 * | 5/2020 | Fujii | G01R 21/12 |
| 2009/0051462 | A1 * | 2/2009 | Rottmoser | H01P 5/187 333/112 |
| 2012/0256616 | A1 * | 10/2012 | Brown | H01P 1/2135 324/76.23 |
| 2020/0251800 | A1 * | 8/2020 | Zhang | H01P 5/184 |

* cited by examiner

*Primary Examiner* — Dean O Takaoka
(74) *Attorney, Agent, or Firm* — Myers Bigel, P.A.

(57) ABSTRACT

The present disclosure relates to couplers suitable for use in communications systems. The coupler comprises: a main conductive line comprising a first main section and a second main section; a first auxiliary conductive line comprising a first auxiliary section and a first end portion, wherein the first auxiliary section is configured to couple with the main conductive line to generate a first coupled signal; a second auxiliary conductive line comprising a second auxiliary section and a second end portion, wherein the second auxiliary section is configured to couple with the main conductive line to generate a second coupled signal; a transmission module that is configured to combine the first coupled signal and the second coupled signal into an output signal of the microstrip coupler and to pass the output signal to an outlet; and a coupled port coupled to the outlet and used for outputting the output signal.

20 Claims, 2 Drawing Sheets

COUPLERS FOR COMMUNICATIONS SYSTEMS

CROSS-REFERENCE TO RELATED APPLICATION

The present application claims priority under 35 U.S.C. § 119 to Chinese Patent Application No. 201810780299.5 (Serial No. 2018071700656530), filed Jul. 17, 2018, the entire content of which is incorporated herein by reference.

FIELD OF THE INVENTION

The present disclosure relates to communications systems and, more particularly, to couplers suitable for use in communications systems.

BACKGROUND

Couplers are widely used in the radio communications industry. Couplers may, for example, have an input port, an output port and a coupled port. A coupler may be configured to pass a first portion of a radio frequency ("RF") signal that is input at the input port to the output port while coupling a second portion of the RF signal to the coupled port.

SUMMARY

A first aspect of this disclosure is to provide a microstrip coupler. The microstrip coupler may comprise: a main conductive line comprising a first main section and a second main section; a first auxiliary conductive line comprising a first auxiliary section and a first end portion, wherein the first auxiliary section is adjacent and spaced apart from the first main section and is configured to couple with the main conductive line to generate a first coupled signal; a second auxiliary conductive line comprising a second auxiliary section and a second end portion, wherein the second auxiliary section is adjacent and spaced apart from the second main section and is configured to couple with the main conductive line to generate a second coupled signal; a transmission module comprising a first inlet, a second inlet and an outlet, wherein the first inlet is coupled to the first end portion, the second inlet is coupled to the second end portion, and the transmission module is configured to combine the first coupled signal from the first end portion and the second coupled signal from the second end portion into an output signal of the microstrip coupler and to pass the output signal to the outlet; and a coupled port coupled to the outlet and used for outputting the output signal.

A second aspect of this disclosure is to provide a coupler. The coupler may comprise: an input port; an output port; a combining node; a coupled port that is coupled to the combining node; a main transmission line that couples the input port to the output port; a first coupling element that is configured to pass a first coupled signal to the combining node, the first coupled signal comprising a first portion of a signal that is input to the main transmission line at the input port that is coupled from the main transmission line by the first coupling element; and a second coupling element that is configured to pass a second coupled signal to the combining node, the second coupled signal comprising a second portion of the signal that is input to the main transmission line at the input port that is coupled from the main transmission line by the second coupling element; wherein the first coupling element is spaced apart from the second coupling element.

Figure 1:
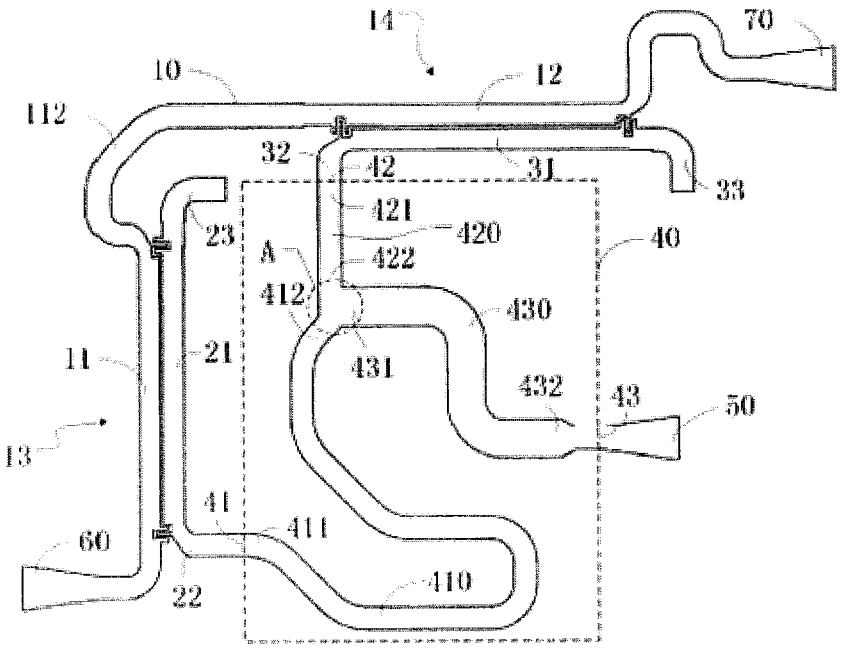
FIG. 1 schematically illustrates a configuration of a coupler according to one or more exemplary embodiments of the present invention.

Note that, in some cases the same elements or elements having similar functions are denoted by the same reference numerals in different drawings, and description of such elements is not repeated. In some cases, similar reference numerals and letters are used to refer to similar elements, and thus once an element is defined in one figure, it need not be further discussed for following figures.

In order to facilitate understanding, the position, size, range, or the like of each structure illustrated in the drawings may not be drawn to scale. Thus, the disclosure is not necessarily limited to the position, size, range, or the like as disclosed in the drawings

DETAILED DESCRIPTION

The present invention will be described with reference to the accompanying drawings, which show a number of example embodiments thereof. It should be understood, however, that the present invention can be embodied in many different ways, and is not limited to the embodiments described below. Rather, the embodiments described below are intended to make the disclosure of the present invention more complete and fully convey the scope of the present invention to those skilled in the art. It should also be understood that the embodiments disclosed herein can be combined in any way to provide many additional embodiments.

The terminology used herein is for the purpose of describing particular embodiments, but is not intended to limit the scope of the present invention. All terms (including technical terms and scientific terms) used herein have meanings commonly understood by those skilled in the art unless otherwise defined. For the sake of brevity and/or clarity, well-known functions or structures may be not described in detail.

Herein, when an element is described as located "on" "attached" to, "connected" to, "coupled" to or "in contact with" another element, etc., the element can be directly located on, attached to, connected to, coupled to or in contact with the other element, or there may be one or more intervening elements present. In contrast, when an element is described as "directly" located "on", "directly attached" to, "directly connected" to, "directly coupled" to or "in direct contact with" another element, there are no intervening elements present. In the description, references that a first element is arranged "adjacent" a second element can mean that the first element has a part that overlaps the second element or a part that is located above or below the second element.

Herein, the foregoing description may refer to elements or nodes or features being "connected" or "coupled" together. As used herein, unless expressly stated otherwise, "connected" means that one element/node/feature is electrically, mechanically, logically or otherwise directly joined to (or directly communicates with) another element/node/feature. Likewise, unless expressly stated otherwise, "coupled"

means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

Herein, terms such as "upper", "lower", "left", "right", "front", "rear", "high", "low" may be used to describe the spatial relationship between different elements as they are shown in the drawings. It should be understood that in addition to orientations shown in the drawings, the above terms may also encompass different orientations of the device during use or operation. For example, when the device in the drawings is inverted, a first feature that was described as being "below" a second feature can be then described as being "above" the second feature. The device may be oriented otherwise (rotated 90 degrees or at other orientation), and the relative spatial relationship between the features will be correspondingly interpreted.

Herein, the term "A or B" used through the specification refers to "A and B" and "A or B" rather than meaning that A and B are exclusive, unless otherwise specified.

The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the detailed description.

Herein, the term "substantially", is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

Herein, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise", "include", "have" and any other variants, as used herein, specify the presence of stated features, steps, operations, elements, and/or components, but do not preclude the presence or addition of one or more other features, steps, operations, elements, components, and/or groups thereof.

Referring to FIG. 1, a configuration of a microstrip coupler according to an exemplary embodiment of the present invention is shown. The microstrip coupler includes a main conductive line 10, a first auxiliary conductive line, a second auxiliary conductive line, a transmission module 40, a coupled port 50, an input port 60 and an output port 70.

The main conductive line 10 comprises a first main section 11, a second main section 12, and a conductor 112 that couples the first main section 11 to the second main section 12. A first end of the main conductive line 10 is coupled to the input port 60, and the second end is coupled to the output port 70. When an input signal is passed through the input port 60 to the main conductive line 10, a first portion of the energy of the input signal passes from the input port 60 to the output port 70, and a second portion of energy of the input signal passes to the coupled port 50.

The first auxiliary conductive line comprises a first auxiliary section 21, a first end portion 22 and a first isolated end portion 23. The first auxiliary section 21 may be adjacent and spaced apart from the first main section 11 so that the first auxiliary section 21 extends substantially in parallel with the first main section 11. The first auxiliary section 21 couples with the main conductive line 10 to generate a first coupled signal on the first auxiliary section 21. A first portion of the energy of the first coupled signal may pass to the first end portion 22 of the first auxiliary section 21, and a second portion of the energy of the first coupled signal may pass to the first isolated end portion 23 of the first auxiliary section 21. In some embodiments, the length of the first auxiliary section 21 of the first auxiliary conductive line may be $\lambda/4$, where $\lambda$ refers to the wavelength corresponding to the center frequency of a signal propagating in the first auxiliary section 21. The coupler may be designed to operate on RF signals in a specific frequency band, and hence the signal propagating in the first auxiliary section 21 and in other portions of the coupler may be within the specific frequency band. The length of the first main section 11 of the main conductive line 10 that is adjacent the first auxiliary section 21 may also be $\lambda/4$. The first end portion 22 and the first isolated end portion 23 of the first auxiliary conductive line may extend gradually away from the main conductive line 10. In some embodiments, the first isolated end portion 23 may be grounded through a matched load (e.g., the matched load is 50 ohms for a 50-ohm system).

The second auxiliary conductive line comprises a second auxiliary section 31, a second end portion 32 and a second isolated end portion 33. The second auxiliary section 31 may be adjacent and spaced apart from the second main section 12 so that the second auxiliary section 31 extends substantially in parallel with the second main section 12. The second auxiliary section 31 couples with the main conductive line 10 to generate a second coupled signal on the second auxiliary section 31. A first portion of the energy of the second coupled signal may pass to the second end portion 32 of the second auxiliary section 31, and a second portion of the energy of the second coupled signal may pass to the second isolated end portion 33 of the second auxiliary section 31. In some embodiments, the length of the second auxiliary section 31 of the second auxiliary conductive line is $\lambda/4$, where $\lambda$ is the wavelength corresponding to the center frequency of a signal propagating in the second auxiliary section 31. The length of the second main section 12 of the main conductive line 10 that is adjacent the second auxiliary section 31 may also be $\lambda/4$. The second end portion 32 and the second isolated end portion 33 of the second auxiliary conductive line may extend gradually away from the main conductive line 10. In some embodiments, the second isolated end portion 33 may be grounded through a matched load (e.g., the matched load is 50 ohms for a 50-ohm system).

The transmission module 40 comprises a first inlet 41, a second inlet 42 and an outlet 43. The first inlet 41 is coupled to the first end portion 22, the second inlet 42 is coupled to the second end portion 32, and the outlet 43 is coupled to the coupled port 50. The first auxiliary conductive line and the second auxiliary conductive line may be arranged such that the first end portion 22 and the second end portion 32 are located in the vicinity of the transmission module 40 so as to conveniently couple to the transmission module 40. Appropriate arrangement of the main conductive line 10 and the first and second auxiliary conductive lines may make the structure of the microstrip coupler more compact. The transmission module 40 is used for combining (e.g., adding) a first signal that is passed from the first end portion 22 with a second signal that is passed from the second end portion 32 into an output signal of the microstrip coupler and transmitting the output signal to the outlet 43, and then the output signal is output through the coupled port 50. As the output signal output through the coupled port 50 is a combination of the first signal and the second signal, the output signal of the microstrip coupler may have a magnitude that is higher than that of the first signal or the second signal by appropriately controlling the phase difference between the first signal and the second signal during the combination.

In some embodiments, as shown in FIG. 1, the transmission module 40 further includes a first transmission line 410, a second transmission line 420 and a third transmission line 430. An end portion 411 of the first transmission line 410 is coupled to the first inlet 41, an end portion 421 of the second transmission line 420 is coupled to the second inlet 42, and an end portion 431 of the third transmission line 430 is coupled to the other end portion 412 of the first transmission line 410 and the other end portion 422 of the second transmission line 420. The other end portion 432 of the third transmission line 430 is coupled to the outlet 43. A first signal that is passed from the first end portion 22 to the first inlet 41 of transmission module 40 is transmitted over the first transmission line 410. A second signal that is passed from the second end portion 32 to the second inlet 42 of transmission module 40 is transmitted over the second transmission line 420. The first signal and the second signal are combined at the region A to generate the output signal of the microstrip coupler, and the output signal generated is transmitted to the outlet 43 in the third transmission line 430. For a 50-ohm system, the resistance value of each of the first and second transmission lines may be 50 ohms, and the resistance value of the third transmission line may be $\sqrt{50/2\times50}$=35.4 ohms.

In some embodiments, the length of at least one of the first transmission line 410 and the second transmission line 420 may be configured such that at the combining node (region A in FIG. 1), the first signal and the second signal have the same phase (or at least substantially the same phase), that is, the phase difference between the first signal and the second signal is 0. For example, in FIG. 1, the first transmission line 410 is longer than the second transmission line 420, so that the first signal arriving at the region A has the same phase as the second signal arriving at the region A. If the phases of the first signal and the second signal are the same, the output signal generated by combining the first and second signals has the maximum energy, so that the strongest coupling may be achieved. In some embodiments, the length of the third transmission line 430 may be $\lambda/4$, where $\lambda$ refers to the wavelength corresponding to the center frequency of a signal propagating in the third transmission line 430. The impedance matching may be easily performed by the third transmission line 430 with the length $\lambda/4$.

In the example of FIG. 1, the conductor 112 in the main conductive line 10 is used to couple the first main section 11 to the second main section 12. Those skilled in the art may appreciate that the first main section 11 and the second main section 12 may also be directly connected, and may even be partially overlapped or completely overlapped. In these cases, the first auxiliary section 21 and the second auxiliary section 31 may also be directly connected, or may be respectively disposed on both sides of the main conductive line 10. In some embodiments, as shown in FIG. 1, the first main section 11 and the second main section 12 do not overlap, and the first auxiliary conductive line and the second auxiliary conductive line are not directly connected.

In some embodiments, as shown in FIG. 1, optionally, ends of the first main section 11 of the main conductive line 10 and corresponding ends of the first auxiliary section 21 of the first auxiliary conductive line may have an interdigitated structure. Similarly, ends of the second main section 12 of the main conductive line 10 and corresponding ends of the second auxiliary section 31 of the second auxiliary conductive line may have an interdigitated structure. These interdigitated structures contribute to improve flatness of the amplitude or power of the coupled signals.

Figure 2:
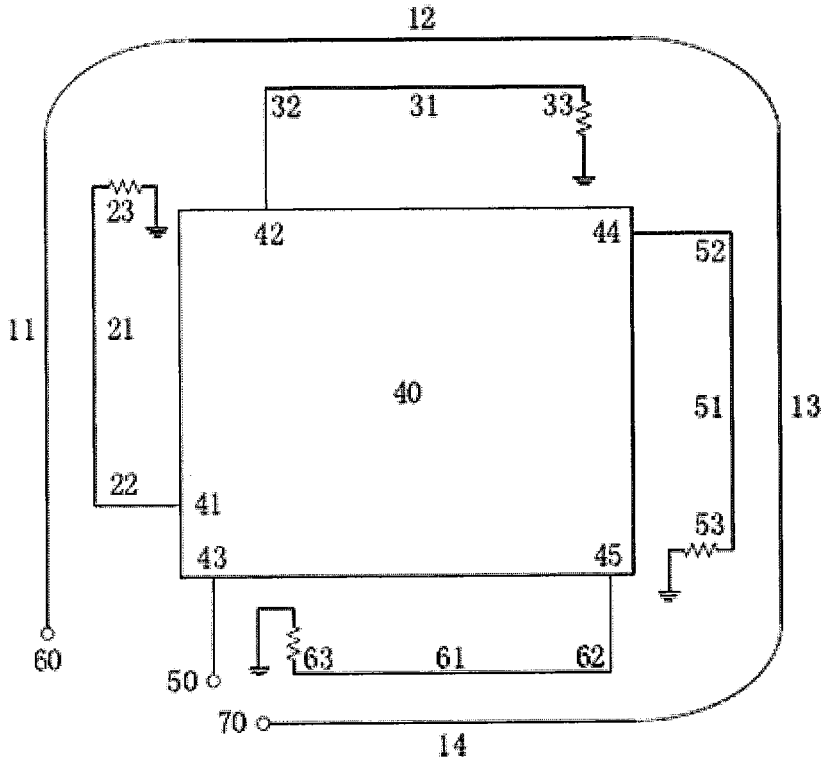
FIG. 2 schematically illustrates a configuration of a coupler according to further exemplary embodiments of the present invention.

Referring to FIG. 2, an embodiment of a microstrip coupler of the present invention is depicted that includes a main conductive line 10, a first auxiliary conductive line, a second auxiliary conductive line, a third auxiliary conductive line, a transmission module 40, a coupled port 50, an input port 60 and an output port 70.

The main conductive line 10 comprises a first main section 11, a second main section 12, and a third main section 13. Although not shown, those skilled in the art will appreciate that the microstrip coupler may also include a conductor similar to the conductor 112 in FIG. 1 for coupling the first main section 11 to the second main section 12, and a conductor for coupling the second main section 12 to the third main section 13. A first end of the main conductive line 10 is coupled to the input port 60, and a second end is coupled to the output port 70. The input port 60 is used for feeding an input signal to the main conductive line 10. A first portion of the energy of such an input signal is passed from the input port 60 to the output port 70, and a second portion of the energy of the input signal is passed to the coupled port 50.

The configurations of the first auxiliary conductive line and the second auxiliary conductive line are as described above with reference to FIG. 1, and thus the descriptions thereof are omitted herein.

The third auxiliary conductive line comprises a third auxiliary section 51, a third end portion 52 and a third isolated end portion 53. The third auxiliary section 51 is adjacent and spaced apart from the third main section 13 so that the third auxiliary section 51 extends substantially in parallel with the third main section 13. The third auxiliary section 51 couples with the main conductive line 10 to generate a third coupled signal on the third auxiliary section 51. A first portion of the energy of the third coupled signal may pass to the third end portion 52 of the third auxiliary section 51, and a second portion of the energy of the third coupled signal may pass to the third isolated end portion 53 of the third auxiliary section 51. In some embodiments, the length of the third auxiliary section 51 of the third auxiliary conductive line may be $\lambda/4$, where $\lambda$ refers to the wavelength corresponding to the center frequency of a signal propagating in the third auxiliary section 51. The length of the third main section 13 of the main conductive line 10 that is adjacent the third auxiliary section 51 may also be $\lambda/4$. The third end portion 52 and the third isolated end portion 53 of the third auxiliary conductive line may extend gradually away from the main conductive line 10. In some embodiments, the third isolated end portion 53 may be grounded through a matched load (e.g., the matched load is 50 ohms for a 50-ohm system).

The transmission module 40 may comprise at least a first inlet 41, a second inlet 42, a third inlet 44 and an outlet 43. The first inlet 41 is coupled to the first end portion 22, the second inlet 42 is coupled to the second end portion 32, the third inlet 44 is coupled to the third end portion 52, and the outlet 43 is coupled to the coupled port 50. In some embodiments, the first auxiliary conductive line, the second auxiliary conductive line and the third auxiliary conductive line may be arranged around the transmission module 40 so as to conveniently perform these couplings. Appropriate arrangement of the main conductive line 10 and the auxiliary conductive lines may make the structure of the microstrip coupler more compact. The transmission module 40 is used for combining (e.g., adding) at least the first coupled signal from the first end portion 22, the second coupled signal from the second end portion 32 and the third coupled signal from the third end portion 52 into an output signal of the microstrip coupler and transmitting the output signal to the outlet 43 The output signal is passed to the coupled port 50. As the output signal output through the coupled port 50 is a combination of at least the first signal, the second signal and the third signal, the output signal of the microstrip coupler may have a strength higher than that of the first signal, the second signal or the third signal by appropriately controlling the phase difference among the first signal, the second signal and the third signal during the combination.

As discussed above with reference to FIG. 1, the transmission module 40 may include first, second, and third transmission lines 410, 420, 430. The transmission module 40 of the embodiment of FIG. 2 may likewise include first, second, and third transmission lines. Although not shown in the drawings, those skilled in the art will appreciate that, in addition to the first, second, and third transmission lines, the transmission module 40 may further comprise a fourth transmission line in some embodiments. A first end portion of the fourth transmission line may be coupled to the third inlet 44, and the second end portion of the fourth transmission line may be coupled to an end portion 431 (see FIG. 1) of the third transmission line in the same manner that ends of the first and second transmission lines are coupled to the end portion 431 of the third transmission line (see, e.g., the region A in FIG. 1), such that the first, second and third signals may be combined to generate the output signal, and the output signal generated is passed to the outlet 43 in the third transmission line. For a 50-ohm system, the resistance value of each of the first, the second and the fourth transmission lines may be 50 ohms and the resistance value of the third transmission line may be $\sqrt{50/3\times50}=28.8$ ohms. In some embodiments, the length of at least one of the first, second, and fourth transmission lines may be configured such that at the location where the first, second and fourth transmission lines connect to the end portion of the third transmission line (i.e., at the combining node that is designated region A in FIG. 1), the first, second and third signals may have substantially the same phase, that is, the phase difference among the first, second and third signals may be close to 0.

As is further shown in FIG. 2, in some embodiments the microstrip coupler may comprise a main conductive line 10, a first auxiliary conductive line, a second auxiliary conductive line, a third auxiliary conductive line, a fourth auxiliary conductive line, a transmission module 40, a coupled port 50, an input port 60 and an output port 70.

The main conductive line 10 comprises a first main section 11, a second main section 12, a third main section 13 and a fourth main section 14. Although not shown, those skilled in the art will appreciate that the microstrip coupler of the present disclosure according to these embodiments may also comprise a conductor similar to the conductor 112 in FIG. 1 for coupling the first main section 11 to the second main section 12, a conductor for coupling the second main section 12 to the third main section 13, and a conductor for coupling the third main section 13 to the fourth main section 14. An end of the main conductive line 10 is coupled to an input port 60, and the other end is coupled to the output port 70. The input port 60 is used for feeding an input signal to the main conductive line 10. A first portion of the energy of the input signal is passed to the output port 70, and a second portion of the energy of the input signal is passed to the coupled port 50.

The configurations of the first auxiliary conductive line and the second auxiliary conductive line are as described above with reference to FIG. 1, and the configuration of the third auxiliary conductive line is as described above with reference to FIG. 2, and thus the descriptions thereof are omitted herein.

The fourth auxiliary conductive line comprises a fourth auxiliary section 61, a fourth end portion 62 and a fourth isolated end portion 63. The fourth auxiliary section 61 may be adjacent and spaced apart from the fourth main section 14 so that the fourth auxiliary section 61 extends substantially in parallel with the fourth main section 14. A portion of the energy of the input signal travelling along the main conductive line 10 couples to the fourth auxiliary section 61 to generate a fourth coupled signal. A first portion of the energy of the fourth coupled signal may pass to the fourth end portion 62 of the fourth auxiliary section 61, and a second portion of the energy of the fourth coupled signal may pass to the fourth isolated end portion 63 of the fourth auxiliary section 61. In some embodiments, the length of the fourth auxiliary section 61 of the fourth auxiliary conductive line may be $\lambda/4$, where $\lambda$ refers to the wavelength corresponding to the center frequency of a signal propagating in the fourth auxiliary section 61. The length of the fourth main section 14 of the main conductive line 10 that runs adjacent to the fourth auxiliary section 61 may also be $\lambda/4$. The two ends of the fourth auxiliary section 61 may extend gradually away from the main conductive line 10, and an end of the fourth auxiliary section 61 is formed into the fourth end portion 62, and the other end is formed into the fourth isolated end portion 63. In some embodiments, the fourth isolated end portion 63 may be grounded through a matched load (e.g., the matched load is 50 ohms for a 50-ohm system).

The transmission module 40 comprises a first inlet 41, a second inlet 42, a third inlet 44, a fourth inlet 45 and an outlet 43. The first inlet 41 is coupled to the first end portion 22, the second inlet 42 is coupled to the second end portion 32, the third inlet 44 is coupled to the third end portion 52, the fourth inlet 45 is coupled to the fourth end portion 62, and the outlet 43 is coupled to the coupled port 50. The first auxiliary conductive line, the second auxiliary conductive line, the third auxiliary conductive line and the fourth auxiliary conductive line may be arranged around the transmission module 40 so as to conveniently perform these couplings. Appropriate arrangement of the main conductive line 10 and the auxiliary conductive lines may make the structure of the microstrip coupler more compact. The transmission module 40 is used for combining (e.g., adding) the first signal from the first end portion 22, the second signal from the second end portion 32, the third signal from the third end portion 52 and the fourth signal from the fourth end portion 62 into an output signal of the microstrip coupler signal and transmitting the output signal to the outlet 43, and then the output signal is output through the coupled port 50. As the output signal output through the coupled port 50 is a combination of the first signal, the second signal, the third signal and the fourth signal, the output signal of the microstrip coupler may achieve a strength higher than that of the first signal, the second signal, the third signal or the fourth signal by appropriately controlling the phase differences among the first signal, the second signal, the third signal and the fourth signal during the combination.

In some embodiments, although not shown in the drawings, those skilled in the art may appreciate that, in addition to the first, second, third and fourth transmission lines, the transmission module 40 may further comprise a fifth transmission line. An end portion of the fifth transmission line may be coupled to the fourth inlet 45, and the other end portion is coupled to an end portion 431 of the third transmission line as the other end of the first, second and fourth transmission lines, for example, in a region similar to the region A in FIG. 1, such that the first, second, third and fourth signals may be combined to generate the output signal, and the output signal generated is transmitted to the outlet 43 in the third transmission line. For a 50-ohm system, the resistance value of each of the first, the second, the fourth and the fifth transmission lines may be 50 ohms, the resistance value of the third transmission line may be $\sqrt{50/4\times50}=25$ ohms. In some embodiments, the length of at least one of the first, second, fourth and fifth transmission lines may be configured such that the first, second, third and fourth signals have the same phase at the coupling portion of the third transmission line that connects to the first, second, fourth and fifth transmission lines.

In addition, although not shown in the drawings, those skilled in the art may appreciate that the microstrip couplers according to embodiments of the present disclosure may further comprise an electrically isolated substrate and a conductive grounding member. The conductive grounding member is disposed on one surface of the electrically isolated substrate, and the main conductive line, the auxiliary conductive lines, and the transmission module are all disposed on the other surface of the electrically isolated substrate. By way of example, the microstrip couplers may be implemented on a printed circuit board that includes a dielectric substrate, and the various traces shown, for example, in FIG. 1, may be implemented as metal patterns formed on a top surface of the printed circuit board, and the grounding member may be implemented by forming a metal sheet on the bottom surface of the printed circuit board underneath the metal patterns.

Note that, the component to which a reference sign in FIG. 2 refers is the component of the microstrip coupler adjacent to the reference sign. Although FIG. 2 shows the microstrip coupler of the present disclosure according to some embodiments in a form of a simplified illustrative diagram, those skilled in the art may obtain a complete and detailed structure of the microstrip coupler of the present disclosure according to these embodiments according to FIG. 1 and FIG. 2. Although the case that the microstrip coupler of the present disclosure according to some embodiments merely comprises three auxiliary conductive lines is not shown in the drawings, those skilled in the art may obtain a complete and detailed structure of the microstrip coupler of the present disclosure according to these embodiments according to FIG. 1 and FIG. 2.

Figure 3:
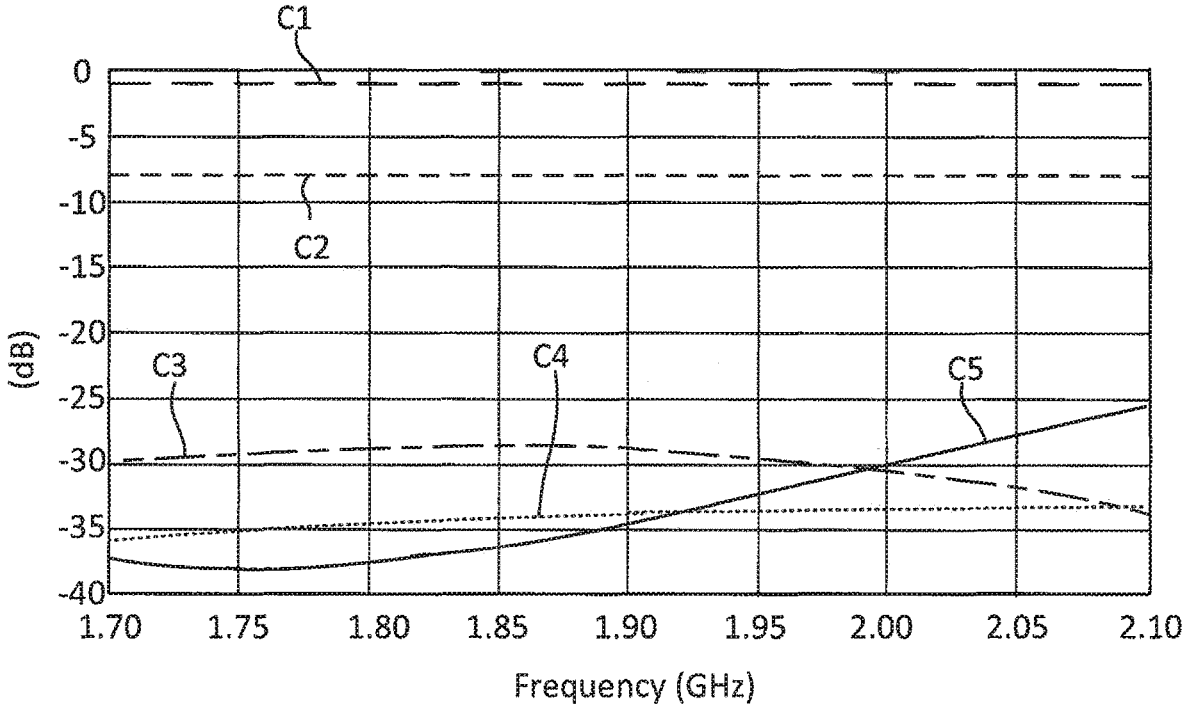
FIG. 3 schematically illustrates S parameters of a microstrip coupler according to an exemplary embodiment of the present invention.

FIG. 3 schematically illustrates S parameters of a microstrip coupler according to one or more exemplary embodiments of this disclosure. The S parameters shown in FIG. 3 correspond to the microstrip coupler that is shown in FIG. 1, where the thickness of the electrically isolated substrate is 30 mils, and the distance between the first main section and the first auxiliary section, and the distance between the second main section and the second auxiliary section, are both 0.24 mm. Those skilled in the art may appreciate that FIG. 3 only schematically illustrates some features of the microstrip coupler of the present disclosure according to some embodiments by taking the microstrip coupler with the above structure as an example, and it does not intend to limit the present disclosure. Those skilled in the art may further appreciate that these structural parameters (e.g., the thickness of the electrically isolated substrate, the distance between the main section and the auxiliary section, etc.) are merely exemplary, and those skilled in the art may change the features of the microstrip coupler by changing the structural parameters. For example, the strength of coupling may be increased by increasing the thickness of the electrically isolated substrate (for example, by increasing the thickness of the electrically isolated substrate from 30 mils to 60 mils, the width of the main section and the width of the auxiliary section will both be increased from 1.9 mm to 3.8 mm while the distance between the main section and the auxiliary section is kept unchanged as 0.24 mm, so that the strength of coupling may be increased), or by reducing the distance between the main section and the auxiliary section.

The curve C1 represents a ratio (the unit of which is dB, hereinafter referred to as a parameter S21) of the signal power passed through the output port 70 of the microstrip coupler to the signal power input through the input port 60 as a function of frequency, the curve C2 represents a ratio (the unit of which is dB, hereinafter referred to as a parameter S31) of the signal power passed through the coupled port 50 to the signal power input through the input port 60 as a function of frequency, the curve C3 represents a ratio (the unit of which is dB, hereinafter referred to as a parameter S41) of the signal power passed through the first isolated end portion 23 to the signal power input through the input port 60 as a function of frequency, the curve C4 represents a ratio (the unit of which is dB, hereinafter referred to as a parameter S51) of the signal power passed through the second isolated end portion 33 to the signal power input through the input port 60 as a function of frequency, and a curve C5 represents a ratio (the unit of which is dB, i.e., return loss) of the signal power reflected back to the input port 60 to the signal power input through the input port 60 as a function of frequency. The points m1~m7 in the figure are points taken on the curves C1~C5, and the x-coordinate and y-coordinate of each point are also shown in FIG. 3.

As can be seen from FIG. 3, at frequencies 1.84 GHz, 1.925 GHz and 2 GHz, the parameters S21 are about −1.0 dB respectively, and the parameters S31 are about −8.0 dB respectively, that is, the ratio of the signal power passed through the output port 70 to the signal power passed through the coupled port 50 is about 7.0 dB at these frequencies. It may also be seen that the insertion loss of the microstrip coupler is about 0.20 dB, and the return loss is about −30 dB at a frequency of 2 GHz. With respect to the microstrip coupler in the prior art, under the same conditions (the thickness of the electrically isolated substrate is 30 mils, and the distance between the coupled microstrip lines is 0.24 mm), the strength of coupling is about −10 dB. It can be seen from FIG. 3, under the above conditions, the strength of coupling of the microstrip coupler of the present disclosure with two auxiliary conductive lines (i.e., the first and second auxiliary conductive lines) may be about −7 dB. In addition, the microstrip coupler of the present disclosure with three auxiliary conductive lines (i.e., the first, second and third auxiliary conductive lines), the strength of coupling may be about −5 dB; and the microstrip coupler of the present disclosure with four auxiliary conductive lines (i.e., the first, second, third and fourth auxiliary conductive lines), the strength of coupling may be about −3 dB. Therefore, the microstrip coupler of the present disclosure may demonstrate increased coupling strength.

As discussed above with respect to the microstrip coupler of FIG. 1, the transmission module 40 may be designed so that the first transmission line is longer than the second transmission line. The lengths of the first and second transmission lines may be selected so that the first coupled signal arriving at the region A in FIG. 1 will have the same phase as the second coupled signal arriving at the region A, allowing the two coupled signals to constructively combine. It should be noted, however, that signal energy will also be reflected through output port 70 back into the microstrip coupler. This reflected signal energy will also couple to the second auxiliary section 31 and to the first auxiliary section 21 and be passed to the region A in FIG. 1. The microstrip couplers according to embodiments of the present invention may be designed so that a first coupled reflected signal that is coupled from the main transmission line 10 to the second auxiliary section 31 and a second coupled reflected signal that is coupled from the main transmission line 10 to the first auxiliary section 21 are out of phase when those first and second coupled reflected signals reach region A in FIG. 1, and hence the first and second coupled reflected signals may substantially cancel each other out. It should be noted that constructively combining a first signal and a second signal herein refers to signal combining that makes the amplitude of a combined signal of the first signal and the second signal be greater than any of the amplitude of the first signal or the amplitude of the second signal. The couplers according to some embodiments of the present invention may be designed so that a first signal and a second signal may be constructively combined to provide a combined signal that has a magnitude that is nearly the sum of the magnitude of the first signal and the magnitude of the second signal.

For example, referring again to FIG. 1, the first main section 11 and the first auxiliary section 21 may form a first coupling element 13. When a signal is input to the main conductive line 10 at input port 60, a first portion of this signal will couple from the first main section 11 to the first auxiliary section 21 to generate a first coupled signal on the first auxiliary section 21. Some of the energy of the first coupled signal will pass to the isolated end portion 23 of the first auxiliary section 21, while the remainder of the energy of the first coupled signal will pass through the end portion 22 of first auxiliary section 21 and over the first transmission line 410 to the combining node at region A. Similarly, the second main section 12 and the second auxiliary section 31 may form a second coupling element 14. A second portion of the signal that is input to the main conductive line 10 at input port 60 will couple from the second main section 12 to the second auxiliary section 31 to generate a second coupled signal on the second auxiliary section 31. Some of the energy of the second coupled signal will pass to the isolated end portion 33 of the second auxiliary section 31, while the remainder of the energy of the second coupled signal will pass through the end portion 32 of second auxiliary section 31 and over the second transmission line 420 to the combining node at region A. As discussed above, the region A may act as a combining node where the first coupled signal combines with the second coupled signal to generate a combined coupled signal that is passed to the coupled port 50.

The first coupling element 13 and the second coupling element 14 are spaced apart from each other by the conductor 112. If, for example, a length of the first transmission line 410 is approximately equal to the sum of a length of the conductor 112 and a length of the second transmission line 420, then the first coupled signal and the second coupled signal may be substantially in-phase when those signals meet at the combining node (region A) in FIG. 1. Consequently, the first coupled signal and the second coupled signal will constructively combine to provide a combined coupled signal having a magnitude that is substantially greater than the magnitude of either the first coupled signal or the magnitude of the second coupled signal. In some embodiments, a magnitude of the combined coupled signal may be at least 80% of the magnitude of the sum of the magnitude of the first coupled signal and the magnitude of the second coupled signal.

One potential problem with conventional couplers is that they not only couple signal energy that is input at the input port of the coupler, but they also tend couple signal energy that is input at the output port of the coupler to the coupled port. The signal energy that is input at the output port of the coupler may comprise, for example, a reflected signal that is generated when a portion of a signal output from the coupler is reflected back towards the coupler by an imperfect impedance match downstream of the output port 70. If significant portions of such a reflected signal that is input to the coupler at output port 70 are coupled to the coupled port 50, this may, in some applications, have a negative impact on performance. The couplers according to embodiments of the present invention may be configured to reduce the amount of such a reflected signal that is passed to the coupled port 50.

When a reflected signal (or other signal) is input to the main conductive line 10 at output port 70, a first portion of this reflected signal will couple from the second main section 12 to the second auxiliary section 31 to generate a first coupled reflected signal on the second auxiliary section 31. Some of the energy of the first coupled reflected signal will pass to the isolated end portion 33 of the second auxiliary section 31, while the remainder of the energy of the first coupled reflected signal will pass through the end portion 32 of second auxiliary section 31 and over the second transmission line 420 to the combining node at region A. Similarly, a second portion of the reflected signal that is input to the main conductive line 10 at output port 70 will couple from the first main section 11 to the first auxiliary section 21 to generate a second coupled reflected signal on the first auxiliary section 21. Some of the energy of the second coupled reflected signal will pass to the isolated end portion 23 of the first auxiliary section 21, while the remainder of the energy of the second coupled reflected signal will pass through the end portion 22 of first auxiliary section 21 and over the first transmission line 410 to the combining node at region A.

If, for example, a length of the second transmission line 420 is shorter than the sum of a length of the conductor 112 and a length of the first transmission line 410 by $\lambda/2$, where $\lambda$ is the wavelength corresponding to the center frequency of the reflected signal, then the first coupled reflected signal and the second coupled reflected signal may be substantially out-of-phase when those signals meet at the combining node (region A) in FIG. 1. Consequently, the first coupled reflected signal and the second coupled reflected signal may substantially cancel each other out at the combining node. In some embodiments, a magnitude of the combination of the first coupled reflected signal and the second coupled reflected signal may be less than 20% of the sum of the magnitude of the first coupled reflected signal and the magnitude of the second coupled reflected signal. In other embodiments, a magnitude of the combination of the first coupled reflected signal and the second coupled reflected signal may be less than 10% of the sum of the magnitude of the first coupled reflected signal and the magnitude of the second coupled reflected signal. It will also be appreciated that the same sort of cancellation may occur in embodiments that include more than two coupling sections, such as the embodiments discussed above with reference to FIG. 2. In such embodiments, the coupler may be designed so that the combination of the plurality of coupled reflected signals cancel each other out at the combining node (or that subsets cancel each out at a plurality of combining nodes).

Referring again to FIG. 3, it can be seen that the parameter S41 is about −28.5 dB at a frequency of 1.84 GHz, and the parameter S51 is about −33.4 dB at a frequency of 2 GHz. That is to say, if the signal power input through the input port 60 is 250 W, the signal power passed from the first isolated end portion 23 and grounded by a matched load is about 0.35 W, and the signal power passed from the second isolated end portion 33 and grounded by a matched load is about 0.07 W. Therefore, the microstrip coupler of the present disclosure has good directionality.

While the example embodiments of the present invention discussed above are implemented as microstrip couplers, it will be appreciated that embodiments of the present invention are not limited thereto. For example, the couplers described above could also be implemented in stripline. As known to those of skill in the art, stripline is a transmission line medium that is similar to microstrip, but that includes a second dielectric substrate (or an air dielectric) that is disposed above the metal trace pattern and a second ground plane that is disposed on the second dielectric substrate opposite the metal trace pattern. Adding the second ground plane may reduce radiative loss from signals traversing the transmission lines as compared to microstrip.

Although some specific embodiments of the present invention have been described in detail with examples, it should be understood by a person skilled in the art that the above examples are only intended to be illustrative but not to limit the scope of the present invention. The embodiments disclosed herein can be combined arbitrarily with each other, without departing from the scope and spirit of the present invention. It should be understood by a person skilled in the art that the above embodiments can be modified without departing from the scope and spirit of the present invention. The scope of the present invention is defined by the attached claims.

That which is claimed is:

1. A microstrip coupler, comprising:

a main conductive line comprising a first main section and a second main section;

a first auxiliary conductive line comprising a first auxiliary section and a first end portion, wherein the first auxiliary section is adjacent and spaced apart from the first main section and is configured to couple with the main conductive line to generate a first coupled signal;

a second auxiliary conductive line comprising a second auxiliary section and a second end portion, wherein the second auxiliary section is adjacent and spaced apart from the second main section and is configured to couple with the main conductive line to generate a second coupled signal;

a transmission module comprising a first inlet, a second inlet and an outlet, wherein the first inlet is coupled to the first end portion, the second inlet is coupled to the second end portion, and the transmission module is configured to combine the first coupled signal from the first end portion and the second coupled signal from the second end portion into an output signal of the microstrip coupler and to pass the output signal to the outlet; and a coupled port coupled to the outlet and used for outputting the output signal.

2. The microstrip coupler according to claim 1, wherein the first main section and the second main section do not include an overlapping part, and the first auxiliary conductive line is not directly connected to the second auxiliary conductive line.

3. The microstrip coupler according to claim 1, wherein the transmission module further comprises:

a combining node;

a first transmission line coupled between the first inlet and the combining node;

a second transmission line coupled between the second inlet and the combining node; and a third transmission line coupled between the combining node and the outlet.

4. The microstrip coupler according to claim 3, wherein a length of at least one of the first transmission line and the second transmission line is configured such that at the combining node the first coupled signal and the second coupled signal have the same phase.

5. The microstrip coupler according to claim 3, wherein the length of the third transmission line is $\lambda/4$, and $\lambda$ is the wavelength corresponding to the center frequency of a signal propagating in the third transmission line.

6. The microstrip coupler according to claim 1, wherein the first auxiliary conductive line and the second auxiliary conductive line are arranged such that the first end portion and the second end portion are located adjacent the transmission module.

7. The microstrip coupler according to claim 1, wherein, the main conductive line further comprises a third main section;

the microstrip coupler further comprises a third auxiliary conductive line, the third auxiliary conductive line comprises a third auxiliary section and a third end portion, the third auxiliary section is adjacent and spaced apart from the third main section and is configured to couple with the main conductive line to generate a third coupled signal; and the transmission module further comprises a third inlet, the third inlet is coupled to the third end portion, and the transmission module is further configured to combine the first, second and third signals from the first, second and third end portions respectively into the output signal and to pass the output signal to the outlet.

8. The microstrip coupler according to claim 7, wherein the first, second and third auxiliary conductive lines are arranged around the transmission module.

9. The microstrip coupler according to claim 7, wherein, the main conductive line further comprises a fourth main section;

the microstrip coupler further comprises a fourth auxiliary conductive line, the fourth auxiliary conductive line comprises a fourth auxiliary section and a fourth end portion, the fourth auxiliary section is adjacent and spaced apart from the fourth main section and is configured to couple with the main conductive line to generate a fourth coupled signal; and the transmission module further comprises a fourth inlet, the fourth inlet is coupled to the fourth end portion and the transmission module is further configured to combine the first, second, third and fourth signals from the first, second, third and fourth end portions respectively into the output signal and to pass the output signal to the outlet.

10. The microstrip coupler according to claim 9, wherein the first, second, third and fourth auxiliary conductive lines are arranged around the transmission module.

11. A coupler, comprising:

an input port;

an output port;

a combining node;

a coupled port that is coupled to the combining node;

a main transmission line that couples the input port to the output port;

a first coupling element that is configured to pass a first coupled signal to the combining node, the first coupled signal comprising a first portion of a signal that is input to the main transmission line at the input port that is coupled from the main transmission line by the first coupling element;

a second coupling element that is configured to pass a second coupled signal to the combining node, the second coupled signal comprising a second portion of the signal that is input to the main transmission line at the input port that is coupled from the main transmission line by the second coupling element;

wherein the first coupling element is spaced apart from the second coupling element.

12. The coupler according to claim 11, wherein the coupler is configured to constructively combine the first coupled signal and the second coupled signal at the combining node to provide a combined signal, and to pass the combined signal to the coupled port.

13. The coupler according to claim 12, wherein a magnitude of the combined signal is at least 80% of the sum of the magnitude of the first coupled signal and the magnitude of the second coupled signal.

14. The coupler according to claim 11, wherein the first coupling element is further configured to pass a first coupled reflected signal to the combining node, the first coupled reflected signal comprising a first portion of a reflected signal that is input to the main transmission line at the output port that is coupled from the main transmission line by the first coupling element, and the second coupling element is further configured to pass a second coupled reflected signal to the combining node, the second coupled reflected signal comprising a second portion of the reflected signal that is input to the main transmission line at the output port that is coupled from the main transmission line by the second coupling element.

15. The coupler according to claim 14, wherein the coupler is configured so that the first coupled reflected signal and the second coupled reflected signal are substantially cancelled at the combining node.

16. The coupler according to claim 14, wherein a magnitude of the combination of the first coupled reflected signal and the second coupled reflected signal at the coupled port is less than 20% of the sum of the magnitude of the first coupled reflected signal and the magnitude of the second coupled reflected signal.

17. The coupler according to claim 11, wherein the coupler comprises a microstrip coupler or a stripline coupler.

18. The coupler according to claim 11, further comprising:

a first transmission line that couples the first coupling element to the combining node;

a second transmission line that couples the second coupling element to the combining node; and a third transmission line that couples the combining node to the coupled port, and wherein the main transmission line includes a first main section that is part of the first coupling element, a second main section that is part of the second coupling element and a conductor that couples the first main section to the second main section.

19. The coupler according to claim 18, wherein a length of the first transmission line is substantially equal to a sum of a length of a conductor and a length of the second transmission line.

20. The coupler according to claim 18, wherein a length of the second transmission line is substantially is shorter than a sum of a length of the conductor and a length of the first transmission line by $\lambda/2$, where $\lambda$ is the wavelength corresponding to the center frequency of the first coupled signal.

* * * * *